US010518311B2

(12) United States Patent
Amborn

(10) Patent No.: US 10,518,311 B2
(45) Date of Patent: Dec. 31, 2019

(54) FORMING PRESS AND METHOD FOR FORMING A SHEET-LIKE BLANK COMPOSED OF METAL WITH TWO FRAME PARTS THAT ARE MOVABLE TOWARDS ONE ANOTHER

(71) Applicant: Peter Amborn, Neunkirchen-Seelscheid (DE)

(72) Inventor: Peter Amborn, Neunkirchen-Seelscheid (DE)

( * ) Notice: Subject to any disclaimer, the term of this patent is extended or adjusted under 35 U.S.C. 154(b) by 365 days.

(21) Appl. No.: 15/522,045

(22) PCT Filed: Sep. 28, 2015

(86) PCT No.: PCT/EP2015/072243
§ 371 (c)(1),
(2) Date: Apr. 26, 2017

(87) PCT Pub. No.: WO2016/071042
PCT Pub. Date: May 12, 2016

(65) Prior Publication Data

US 2017/0312802 A1 Nov. 2, 2017

(30) Foreign Application Priority Data

Nov. 3, 2014 (EP) ..... 14003701
Dec. 18, 2014 (EP) ..... 14198750

(51) Int. Cl.
*B21D 22/22* (2006.01)
*B21D 22/20* (2006.01)

(52) U.S. Cl.
CPC ..... *B21D 22/205* (2013.01); *B21D 22/20* (2013.01); *B21D 22/22* (2013.01)

(58) Field of Classification Search
CPC ..... B21D 22/20–22/30
(Continued)

(56) References Cited

U.S. PATENT DOCUMENTS 3,871,202 A * 3/1975 Claesson ..... B21J 5/04 72/453.07
5,065,607 A * 11/1991 Kadis ..... B21D 22/22 267/119

(Continued)

FOREIGN PATENT DOCUMENTS

DE 19724767 A1 12/1998
DE 10153600 A1 * 5/2003 ..... B21D 22/205

(Continued)

OTHER PUBLICATIONS

Aust, Translation DE-10153600-A1 (Year: 2003).*
Klaas, Translation DE-102012106299-A1 (Year: 2011).*

*Primary Examiner* — Adam J Eiseman
*Assistant Examiner* — Bobby Yeonjin Kim
(74) *Attorney, Agent, or Firm* — Dinsmore & Shohl LLP

(57) ABSTRACT

A forming press for forming a sheet-like blank has a first thermally insulated frame part having a die with a negative engraving and a second thermally insulated frame part defining a chamber and having a punch movably disposed in the chamber. The sheet-like blank rests in a sealing manner on the second frame part and covers the punch so as to define a pressure chamber with the punch therein. A pressure generator provides a pressurized gas to the pressure chamber during a forming process.

14 Claims, 5 Drawing Sheets

(58) Field of Classification Search
USPC ..... 72/347
See application file for complete search history.

(56) References Cited

U.S. PATENT DOCUMENTS

| | | | | |
|---|---|---|---|---|
| 6,708,543 | B2 * | 3/2004 | Yoshioka | B21D 15/10 29/421.1 |
| 2010/0166903 | A1 * | 7/2010 | Krajewski | B21D 22/22 425/144 |
| 2011/0088442 | A1 * | 4/2011 | Golovashchenko | B21D 22/205 72/60 |
| 2011/0289997 | A1 * | 12/2011 | Barnes | B21D 22/205 72/342.7 |
| 2015/0143861 | A1 * | 5/2015 | Sato | B21D 22/208 72/17.3 |
| 2016/0059295 | A1 * | 3/2016 | Frost | B21D 22/02 72/354.6 |

FOREIGN PATENT DOCUMENTS

| | | | | |
|---|---|---|---|---|
| DE | 102012106299 | A1 * | 7/2011 | B21D 22/20 |
| DE | 102012106299 | A1 | 1/2013 | |
| JP | S5956926 | A | 4/1984 | |

* cited by examiner

FORMING PRESS AND METHOD FOR FORMING A SHEET-LIKE BLANK COMPOSED OF METAL WITH TWO FRAME PARTS THAT ARE MOVABLE TOWARDS ONE ANOTHER

CROSS-REFERENCE TO RELATED APPLICATION

This application claims priority to PCT/EP2015/072243 filed Sep. 28, 2015, which claims priority to EP14003701.1 filed Nov. 3, 2014 and EP14198750.3 filed Dec. 18, 2014.

FIELD OF THE INVENTION

The invention relates to a forming press for forming a sheet-like blank composed of metal with at least two thermally insulated frame parts that are movable towards one another, wherein the one first frame part comprises a die with a negative engraving, and wherein the other second frame part comprises a punch that is movable in a chamber of this frame part, wherein the sheet-like blank rests on the frame part receiving the punch above the punch, so that it forms a pressure chamber with the punch. Another subject matter of the invention is a forming method.

Sheet-like blanks refer more specifically to sheet metal, boards and films.

BACKGROUND OF THE INVENTION

A forming press for forming a sheet-like blank composed of metal is known from the prior art according to DE 10 2012 106 299 A1. It provides in particular a pressure-tight housing, wherein two frame parts are disposed in the housing, wherein the one upper frame part is movable toward the other bottom frame part. The one upper frame part comprises a punch, which is movable in a cylindrical chamber of the frame part, and which features a positive engraving, whereas a die with a correspondingly complementary negative engraving is disposed on the other bottom frame part. The method for forming the sheet-like blank of metal consists in first carrying out a gas-based forming of the blank, and then, in a second step, i.e. when the forming has already substantially taken place, in carrying out a final mechanical forming sheet-like blank in those sections of the die that are characterized by small radiuses. Indeed, according to the teachings of the prior art, gas pressure forming allows achieving proportionately high degrees of deformation relatively simply and quickly, whereas the forming of small radiuses at equally high degrees of deformation requires exerting a disproportionately high pressure on the blank, which makes such a one-step method uneconomical when small radiuses need to be deformed. According to the prior art, the forming of the sheet-like metal blank is carried out by the stroke of the punch, respectively of the frame parts relative to one another, by generating gas pressure. Furthermore, this citation also teaches providing higher pressures for the forming process by increasing the temperature. However, it also teaches to load the pressure chamber, after it has been sealed but before the start of the actual compression stroke, with the gas pressure that has been generated in the previous press stroke, for reducing the compression path and/or for increasing the final pressure. The gas under pressure can be temporarily stored in a pressure vessel. In short, this means that the teaching of the prior art amounts to using the pressure generated by the displacement of the punch, respectively a pressure generated by the displacement of the two frame parts, for the forming process, wherein pressurized air, temporarily stored in a pressure vessel before the actual forming process, is used, as necessary, for increasing the pressure in the chamber above the punch.

Generating the required pressure using gas, as a pressurizing medium, requires considerable traveling distances, which means that the cycle times become relatively long. Since not only the punch is to be used for generating the pressure, and the two frame parts also serve to increase the pressure in the punch chamber, it is necessary to hermetically seal the frame parts of the press, i.e. the upper frame part and the bottom frame part, from the environment. As can be seen in the drawings of DE 10 2012 106 299 A1, a separate housing is provided to this end. It makes not doubt that this requires a considerable constructive and manufacturing effort, which makes such a device, and here more specifically the tool part, relatively expensive.

Therefore, the problem underlying the invention consists in providing a more economical solution for forming a sheet-like blank composed of metal.

SUMMARY OF THE INVENTION

In order to solve the problem, the invention proposes to impinge the pressure chamber with a pressurized gas from a pressure generator. Such a pressure generator can be a compressor, for example, that is able to provide the pressures of up to 60 bar that are required for forming sheet-like blanks.

Advantageous features and embodiments of the invention can be gathered this specification.

The air volume generated by the pressure generator is advantageously closed-loop-controllable or open-loop-controllable in accordance with the current pressure in the pressure chamber. This means that at the beginning of the forming process, the pressure can be relatively low, and that during the final forming process, during which small radiuses must be formed with a high degree of deformation on the blank, the pressure can be correspondingly increased. This means that it is possible to specify a pressure profile that is closely adapted to the appropriate degrees of deformation, using open-loop control or closed-loop control.

Furthermore, it is more specifically provided that the punch can have an at least partially complementary positive engraving that corresponds to the negative engraving on the die. This way, sections with small radiuses can be relatively quickly given their final shape, advantageously mechanically, i.e. ultimately by the engravings. In this respect, the method then includes two steps.

The punch is movably guided in the chamber of the other second frame part in a pressure-tight manner. A radially circumferential piston seal, for example at least one piston ring, is provided for achieving the pressure-tightness. This ensures that the gas pressure remains stable over a longer period of time, so that the gas pressure can act on the blank for a prolonged period.

By using piston rings as punch seals, small accuracy errors that can occur due to warming can be compensated for. It is also conceivable to mount the frame parts in a floating manner, in order to be able to compensate for accuracy errors during operation.

According to another feature of the invention, the die of the one first frame part and/or the punch of the other frame part respectively comprise at least one temperature control unit that is open-loop or closed-loop controllable. The temperature control unit allows heating up the sheet-like blank made of a hot-formable material, in particular made of metal, to the forming temperature required for hot-formable materials, in particular metal, which preferably lies above ca. 300° C., wherein the blank can also be pre-heated externally. The external pre-heating of the blank ensures short cycle times. Depending on the metal to be formed, e.g. a ferritic stainless steel, the sheet-like blank is heated up to 1100° C., where applicable. In principle, all possible combinations of heating the frame part, the die, the punch and finally the blank are conceivable. It must be noted that the prior art according to DE 10 2012 106 299 A1 does not allow carrying out a forming process at such high temperatures. On the one hand, this is due to the fact that although the punch is movably guided in the upper frame part, it is to be expected that when the punch is heated up to temperatures above 300° C., in some cases to temperatures of up to 1100° C., the punch will no longer be displaceable in the upper frame part, because the frame part radiates a lot of heat through its outer surface, which would make it difficult to maintain the frame part, or both frame parts, at or cool them to the temperatures required for a similar temperature-induced expansion, if the frame parts and the punch are made of materials that have at least similar temperature expansion coefficients. Therefore, as has been explained earlier, it is also provided that the punch is sealed off with respect to the chamber in the frame part by at least one radially circumferential piston seal, in particular by at least one, preferably several piston rings, at least for round punches. In this respect, it is then also possible to reach higher temperatures. In addition, using a piston seal for sealing as well as the relatively small volume of the pressure chamber make it possible to economically use noble gases, e.g. when forming magnesium alloys.

In particular when arranging several temperature control units, it is provided that the temperature control units are individually open-loop or closed-loop controllable, in order to be able to adjust a predetermined temperature profile, as necessary, wherein the temperature profile can depend on the desired degree of deformation at the respective points of the sheet-like blank. In particular, regarding the arrangement of several temperature control units, it is provided that the die of the one first frame part comprises a temperature control unit in the area in which it is supported on the other second frame part, wherein the other second frame part can correspondingly also comprise a temperature control unit in the area of support of the sheet-like blank. Advantageously, the bottom of the die also comprises a temperature control unit. This means that such a temperature control unit, which can also take the form of a heater, makes it possible to heat the die as a whole. Advantageously the punch also comprises a temperature control unit in the form of a heater in the area of the upper side of the punch. This shows that not only the die and the punch are centrally heatable, but that also the boundary area both of the punch and the die, i.e. those areas in which the two frame parts abut one another and ultimately also ensure the fixation and sealing of the sheet-like blank, are temperature-controllable, i.e. in particular heated, in order to ensure, in particular in this part, by way of a pre-selectable temperature profile, that the material will run, in particular in the case of narrow radiuses with correspondingly high degrees of deformation.

In particular, it is further provided that the initial position of the punch in the more specifically cylindrical chamber of the other second frame part is such that the punch with or without an engraving is located immediately in front of the sheet-like blank, without however deforming it in this initial position. This means that in the case of a punch with an engraving, the engraving possibly abuts at its highest elevation on the sheet-like blank, whereas in the case of a punch without an engraving, i.e. when the forming process is to be carried out using only the appropriate air or gas pressure, the punch is located at a minimal distance in front of or lightly rests on the sheet-like blank. This is to ensure that the pressure can develop across the entire surface of the blank and the blank is not scratched or damaged. However, this also means that the pressure chamber between the upper side or surface of the punch and the bottom side of the blank can be kept relatively small. This is advantageous in that the pressure generator only needs to generate a low volume flow with the appropriate pressure, in order to be able to achieve relatively short cycle times. It is also advantageous that in the case of a small pressure chamber, the cooling of the blank and tools such as the punch and the die is low due to the gas supplied by the pressure generator, so that the energy demands of the temperature control units for heating the sheet-like blank made of metal are also low. This avoids process interruptions caused by an excessive cooling of the tools.

However, it is also possible to first close the frame parts with a closing force that allows for a mechanical forming of the blank, wherein the material of the blank can be slightly drawn into the engraving of the die from the outside. After an increase of the closing force and an associated sealing, the gas pressure is then built up for forming.

According to another feature of the invention, the chamber under the punch is connected to the chamber formed by the engraving of the die by way of a pressure equalising pipe. This means that an increase of the pressure on the side of the blank that faces the die, which would be detrimental to the forming process, is prevented in particular during the final forming process.

In this context, it is advantageously provided that the pressure equalising pipe is connected to the pressure generator, in order to generate an excess pressure between the die and the blank, in order to eject the completed work piece in controlled manner using the pressure in the intermediate space between the die and the tool. When the chamber under the punch is sealed, the formed work piece can be automatically pushed out of the die by the retracting movement of the punch while the tools are simultaneously opened. In this regard an externally closed-loop controllable pressurized air management system can be provided in any combination.

Another subject matter of the invention is a method for forming a sheet-like blank in a forming press as described above. The process is characterized by several work steps, which are described in more detail in the following. First, the sheet-like blank is placed, in particular in a preheated state, on the other second frame part. The frame parts are then closed, so that the sheet-like blank is held between the frame parts in a sealed-off manner. The punch is then moved up to the sheet-like blank for forming the pressure chamber. However this ensures that the blank is not deformed by the engraving of the punch, if the punch comprises an engraving. The sheet-like blank is then heated up to a forming temperature that is specific to the material of the sheet-like blank. Depending on the material to be formed, the desired forming temperature can, for example, amount to between 300° C. and 1100° C. in the case of light metals and certain copper alloys and between 700° C. and 1100° C. for steel-like alloys as well as copper alloys and titanium alloys. In this respect, the blank can also be introduced into the press in a pre-heated state, which significantly reduces cycle times.

Once the frame parts have been moved toward each other and the pressure chamber, which is formed by the sheet-like blank on the one hand and the punch in the cylindrical chamber of the bottom frame part, has been sealed off, the pressure chamber thus formed is pressurized with a pressurized gas that is chosen according to the alloy. The closing of the frames can be carried out in different ways; one possibility is from the bottom up, as shown in the drawings, meaning that the bottom frame part including the punch is moved upward, or the bottom frame part is fixed and the upper frame part is moved downward toward the bottom frame part. Positioning the die in the upper frame part has the advantage that it is easier to remove the work piece after forming. After the gas-based forming process, wherein the gas pressure can also act on the blank for a longer period of time, the gas pressure between the formed work piece and the punch is first released and the two frame parts are then moved apart, wherein the formed work piece is detached from the die surface by the gas pressure build-up between the die and the work piece and is pressed against the bottom frame part. The completed work piece can then be removed from bottom frame part and provided to a thermal treatment. The forming process can also be carried out in two steps, wherein, in the first step, forming of the sheet-like blank is carried out using the gas pressure and in the second step, a final forming of the sheet-like blank is carried out mechanically by pressing the punch into the die, as has already been described in more detail earlier.

BRIEF DESCRIPTION OF THE DRAWINGS

In the following the invention will be exemplarily described in more detail based on the drawings.

DETAILED DESCRIPTION OF THE PREFERRED EMBODIMENTS

Figure 1:
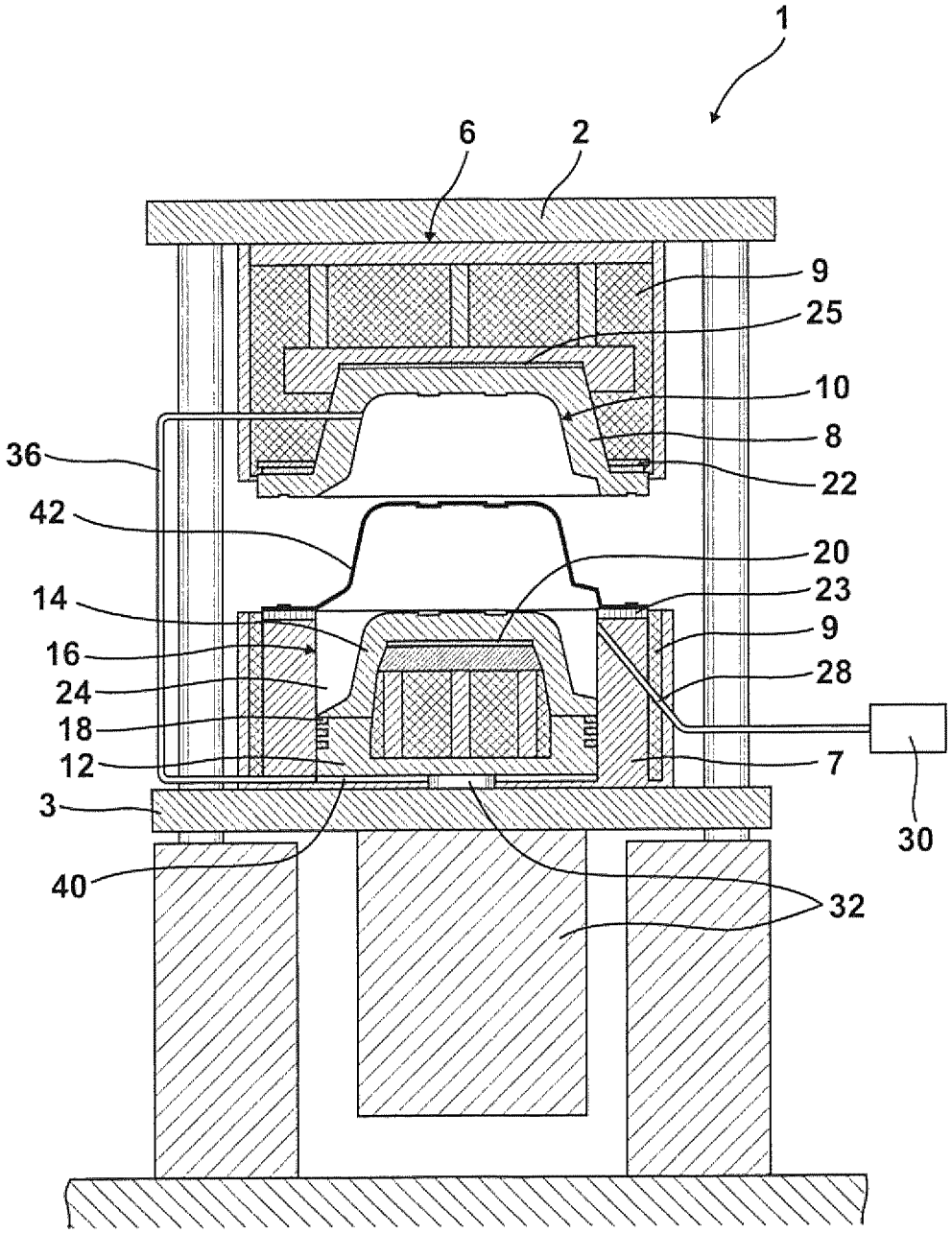
FIG. 1 is an overview drawing of the invention for explaining the components of the forming press.
Figure 2:
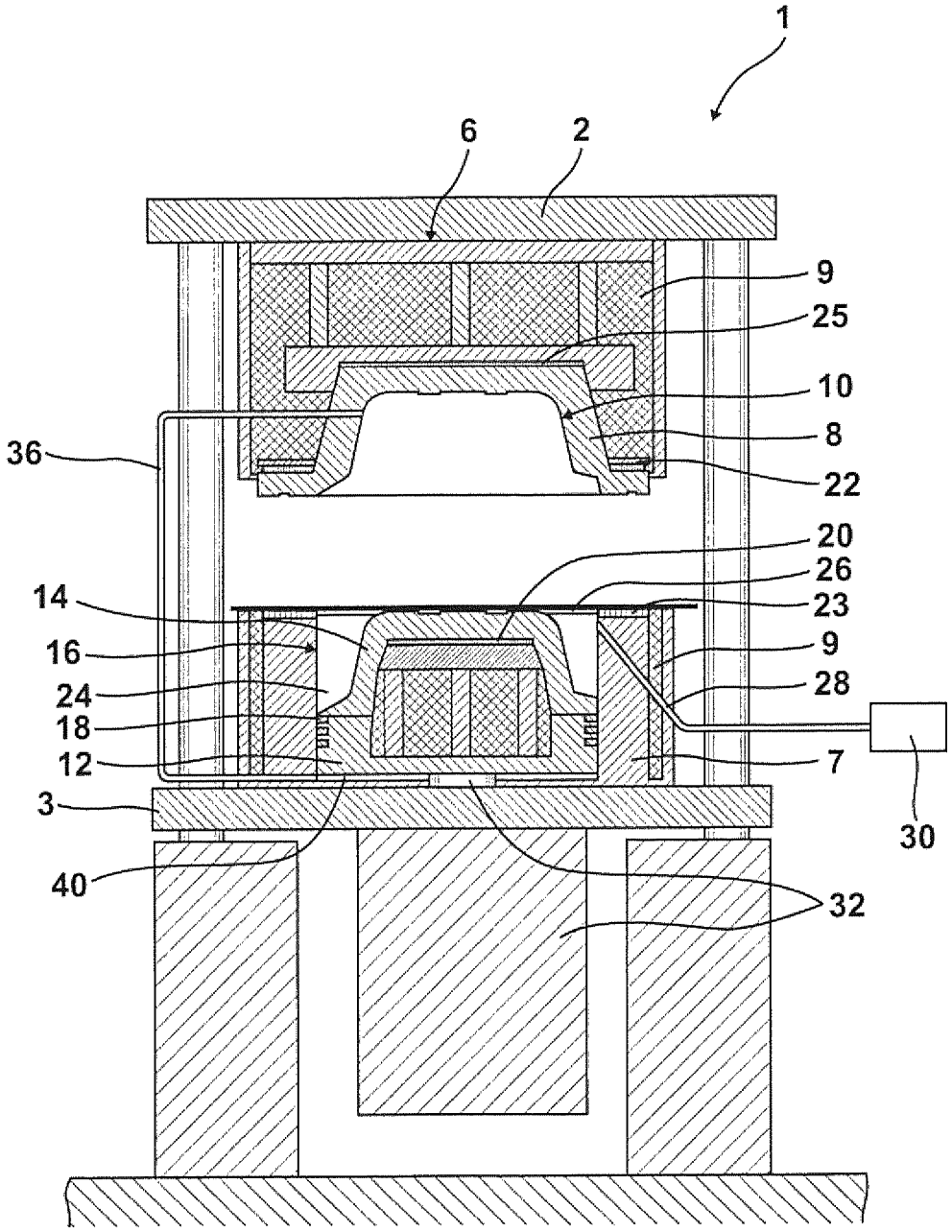
FIG. 2 is a drawing showing the initial state of the press after insertion of the sheet-like blank made of metal.

According to FIGS. 1 to 5, the thermally insulated upper frame part 6 is fastened to the upper press part 2 of the forming press 1 and the bottom frame part 7 is fastened to the bottom press part 3. Both frame parts are heatable, as has been described earlier. The insulation has the reference number 9. The upper frame part 6 comprises the die with the reference number 8, which is also thermally insulated and which features the negative engraving 10, which is disposed in the upper frame part, in such a manner that it can be exchanged depending on the project. Correspondingly, the bottom frame part features the punch labelled 12 with the positive engraving 14, which is formed so that it complements the negative engraving 10 of the die 8. This means that the positive engraving 14 of the punch 12 corresponds to the shape of the negative engraving 10 of the die 8 for forming the work piece 42 from the sheet-like blank 26. The punch 12, which is displaceably mounted in the cylindrical chamber 16 formed by the bottom frame part 7, features several piston rings 18. The piston rings 18 primarily serve to seal off the punch 12 from the cylindrical chamber 16. As has already been mentioned earlier, the piston rings also ensure that, even at temperatures of the punch 12 of up to 1100° C. for heating the positive engraving 14 with the aim of heating the blank 26, the punch 12 is still moveable in the cylindrical chamber 16; indeed, the piston rings 18 allow compensating for a different thermal expansion of the punch 12 on the one hand and the cylindrical chamber 16 formed by the bottom frame part on the other hand. This means that a "fretting" of the two components is highly unlikely even at highly different temperatures and with different materials. This is in contrast with the prior art, which does not feature such piston rings.

As can be gathered in particular from the figures, the heating of the sheet-like blank 26 takes place in different places, as has already been explained earlier. On the one hand, a temperature control unit is provided as a heater, labelled 20, in the punch 12. The heater 20 is located at the bottom of the punch below the positive engraving 14 of the punch. Another temperature control unit in the form of a heater 23 is disposed in or at the bottom frame part, namely where the die 8 rests on the bottom frame part 7. Correspondingly, the die 8 also comprises a temperature control unit in the form of a heater 22 in this area, in order to at least partially heat up the sheet-like blank 26 in this area, if necessary on both sides, or to generate a heat profile. An additional temperature control device in the form of a heater 25 is provided in the bottom area of the negative engraving 10 of the die 8 between the upper frame part 6 and the negative engraving 10 for heating the negative engraving 10 of the die 8.

The pressure chamber 24 is formed by the bottom side of the sheet-like blank 26, the upper side of the positive engraving 14 of the punch 12 and by the bottom frame part 7.

The pressure chamber 24 is connected with a pressure generator 30 by way of a connection pipe 28. This means that the pressure generator 30, for example a compressor, ensures an increase of the gas pressure of the pressure chamber 24.

The punch 12 comprises a piston cylinder drive 32, which serves for displacing the punch 12 in the cylindrical chamber 16 formed by the bottom frame part 7.

FIGS. 2 to 5 show the forming process. Based on FIG. 2, in its initial position, the positive engraving 14 is located immediately at the bottom side of the sheet-like blank 26, which is to be formed. The two frame parts 6 and 7 are in the opened state.

Figure 3:
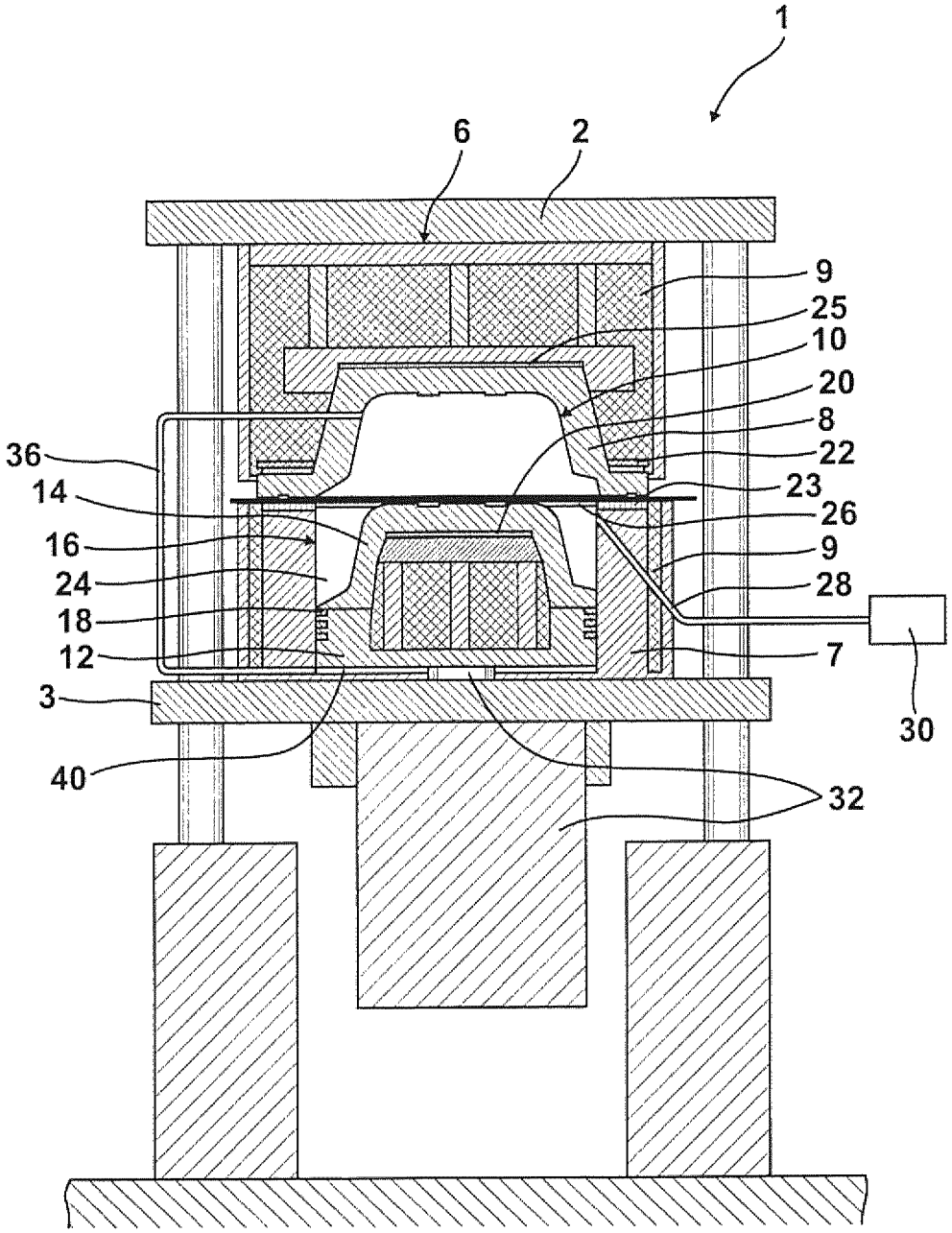
FIG. 3 is a drawing showing the closed state of the two press parts before the forming process.
Figure 4:
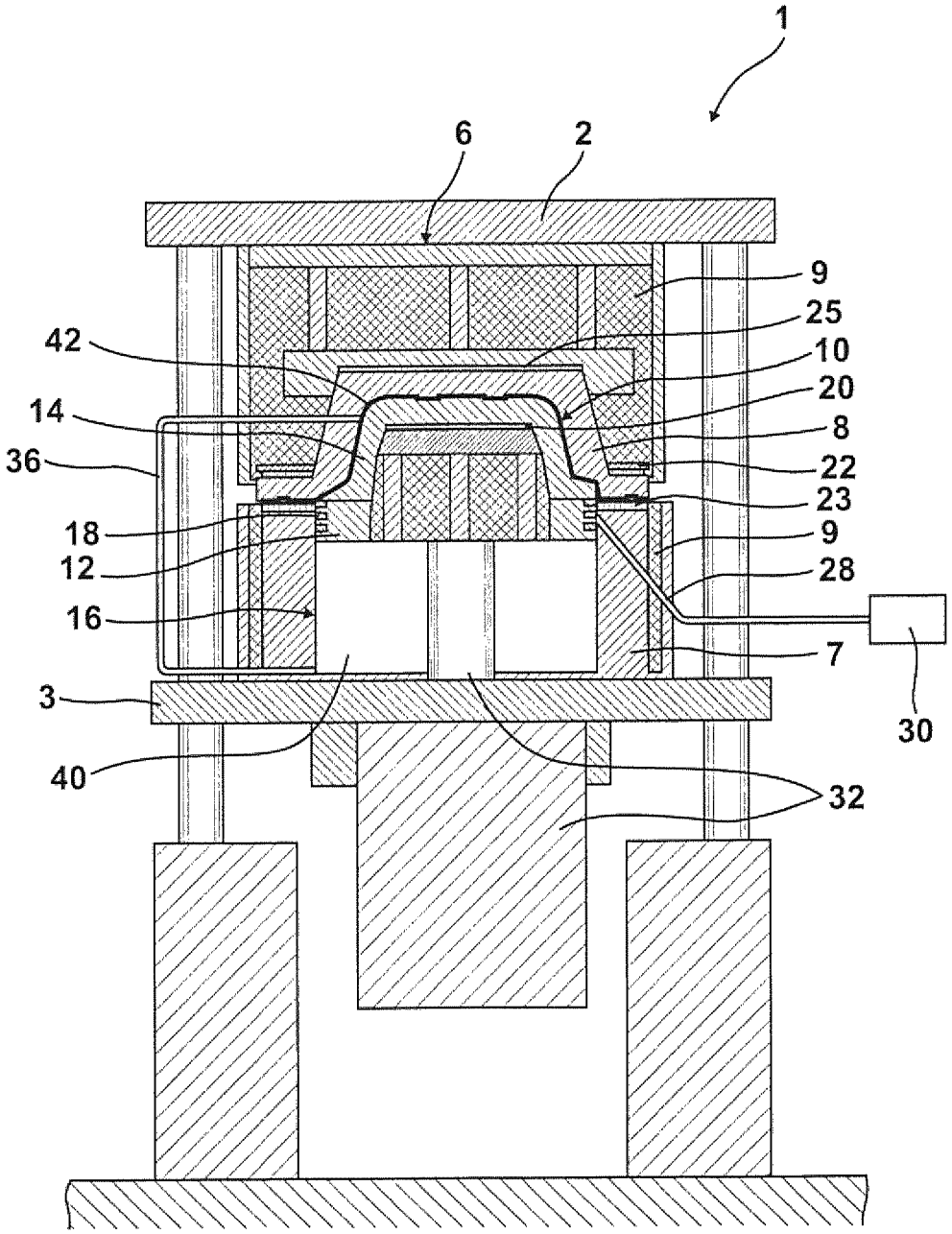
FIG. 4 is a drawing showing a state in which the punch with the positive engraving is driven into the negative engraving of the die.

FIG. 3 shows the state, in which the two frame parts 6 and 7 are closed and now ensure, together with the blank 26, that the pressure chamber 24 is sealed. In this state, the gas pressure in the pressure chamber 24 is now increased by the pressure generator 30. In a first step of this process, the sheet-like blank 26 is formed in the negative engraving 10 of the die 8 by the gas pressure. Once the blank 26 has reached a certain state of deformation, the punch 12 follows, i.e. the punch 12 follows in parallel with the forming process using the gas pressure, wherein the gas pressure increases due to the reduction of the gas volume, in order to then carry out the mechanical final forming in the boundary areas, in particular in the boundary areas with a small radius, if applicable by means of the positive engraving 14 of the punch 12 together with the negative engraving 10 of the die 8. This means that immediately before reaching the final formed state, the remaining forming process substantially takes place purely mechanically due to the positive engraving 14 of the punch 12 running into the negative engraving 10 of the die 8, in particular when small form radiuses must be precisely formed, for example in the boundary area. However, the invention also includes a displacement of the punch simultaneously with the forming process using the gas pressure. Before the mechanical forming process following the gas forming process, it is advisable to at least partially release the now harmful gas pressure between the punch and the almost completely formed work piece.

Figure 5:
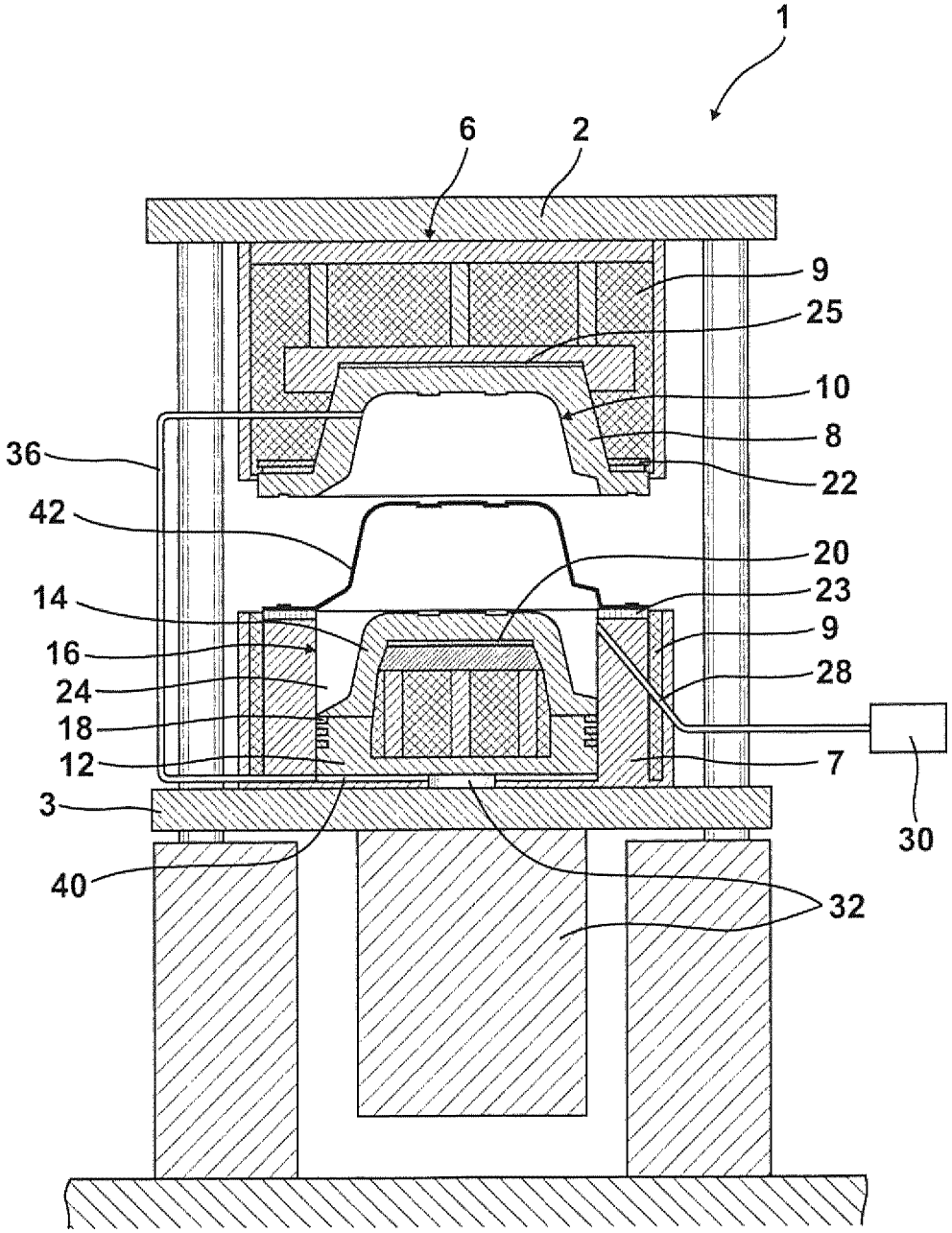
FIG. 5 is a drawing showing the work piece having fallen out or having been ejected out of the opened frame parts.

In order to prevent a counter-pressure from building up within the negative engraving 10 of the die 8, during the forming process, a pressure equalising pipe 36 in the form of a flexible tube is provided between the sealed space 40 below the punch 12 and the space formed by the negative engraving 10 of the die 8. The final formed state can be seen in the representation according to FIG. 4. FIG. 5 shows a representation, in which the blank 26 has been formed into a completed work piece 42. When the pressure equalising pipe 36 in the form of a flexible tube is connected with a pressure generator (not shown), if the pressure within the space formed by the negative engraving 10 of the die 8 increases, a corresponding pressure can be built up for ejecting the work piece 42, i.e. the completely shaped blank. The work piece 42 is then ejected sideways out of the forming press 1. In this context, reference is again made to the prior art according to DE 10 2010 106 299 A1, which does not show how the completed work piece is to get out of the pressure-tight press housing after the frame parts have opened, or how the blank is to be inserted into it.

LIST OF REFERENCE NUMBERS

1 Forming press
2 Upper press part
3 Bottom press part
6 First frame part (upper frame part)
7 Second frame part (bottom frame part)
8 Die
9 Insulation
10 Negative engraving
12 Punch
14 Positive engraving
16 Chamber (cylindrical)
18 Piston ring
20 Heater at the bottom of the punch
22 Heater in the boundary area of the die
23 Heater in the boundary area of the bottom frame part
24 Pressure chamber
25 Heater of the negative engraving
26 Sheet-like blank
28 Connection pipe
30 Pressure generator
32 Piston cylinder drive
36 Pressure equalising pipe
40 Space below the punch
42 Work piece

The invention claimed is:

1. A method for forming a sheet-like blank with a press, comprising:
providing a forming press for forming a sheet-like blank, comprising:
a first thermally insulated frame part having a die with a negative engraving;
a second thermally insulated frame part defining a chamber and having a punch movably disposed in the chamber;
a sheet-like blank resting in a sealing manner on the second frame part and covering the punch so as to define a pressure chamber with the punch therein; and
a pressure generator providing a pressurized gas to the pressure chamber during a forming process;
placing the sheet-like blank onto the second thermally insulated frame part;
moving the frame parts toward each other;
heating the sheet-like blank to a forming temperature that is specific to the material of the sheet-like blank;
pressurizing the pressure chamber with the pressurized gas;
moving the punch into the negative engraving of the die;
releasing the gas pressure at least to a level that allows opening the frame parts;
moving the frame parts apart after forming the sheet-like blank;
removing a completed work piece;
moving the punch into an initial position, wherein the punch rests on a bottom side of the sheet-like blank prior to forming.

2. The method according to claim 1, further comprising a step of holding the frame parts closed with such a force that the sheet-like blank is held between the frame parts in a sealed manner, without the material of the blank being able to flow out laterally.

3. The method according to claim 1, further comprising a step of holding the frame parts closed with a force that allows forming the blank, the material of the blank being able to flow into the negative engraving of the die from an outside.

4. The method of claim 1, wherein the punch has an at least partially complementary positive engraving that corresponds to the negative engraving of the die.

5. The method of claim 1, wherein a forming process, the punch is movable upwardly from a bottom of the chamber of the second frame part.

6. The method of claim 1, wherein the punch is movably guided in the chamber of the second frame part in a pressure-tight manner.

7. The method of claim 6, further comprising at least one radially circumferential piston seal movably guiding the punch in a pressure-tight manner.

8. The method of claim 1, further comprising at least one temperature control unit operable to control a temperature of the die of the first frame part and/or the punch of the second frame part, the at least one temperature control unit being an open-loop or closed-loop controller.

9. The method of claim 8, wherein the at least one temperature control unit comprises a plurality of temperature control units, each temperature control unit individually being an open-loop or closed-loop controller.

10. The method of claim 8, wherein the at least one temperature control unit comprises a temperature control unit in an area supported on the second frame part.

11. The method of claim 10, wherein the at least one temperature control unit further comprises a temperature control unit in an area of support of the sheet-like blank.

12. The method of claim 1, wherein the sheet-like blank is held between the first and second frame parts in a sealed-off manner.

13. The method of claim 1, wherein:
the chamber in the second frame part is a cylindrical chamber;

the punch has an initial position in the cylindrical chamber such that the punch is located immediately adjacent the sheet-like blank without forming the sheet-like blank.

14. The method of claim 1, further comprising a pressure equalizing pipe connecting a portion of the chamber in the second frame part under a piston with a chamber formed by the negative engraving of the die of the first frame part.

* * * * *